United States Patent [19]

Voltmer et al.

[11] Patent Number: 4,493,744

[45] Date of Patent: Jan. 15, 1985

[54] LABELING MACHINES

[75] Inventors: Helmut Voltmer, Park Ridge; Alfred F. Schwenzer, Totowa; John D. Spano, Hasbrouck Heights, all of N.J.

[73] Assignee: NJM, Inc., Fairfield, N.J.

[21] Appl. No.: 498,138

[22] Filed: May 25, 1983

Related U.S. Application Data

[63] Continuation-in-part of Ser. No. 382,940, May 28, 1982.

[51] Int. Cl.[3] ..... B65C 9/08

[52] U.S. Cl. ..... 156/568; 156/571; 271/94; 271/107; 271/112

[58] Field of Search ..... 156/566, 571, 572, 584, 156/568; 271/94, 107, 111, 112, 109

[56] References Cited

U.S. PATENT DOCUMENTS

| | | | |
|---|---|---|---|
| 2,652,941 | 9/1953 | Carter | 156/571 |
| 2,769,561 | 11/1956 | Von Hofe et al. | 156/571 X |
| 3,322,597 | 5/1967 | Vite | 156/571 |
| 3,537,934 | 11/1970 | Munch | 156/571 X |
| 3,654,024 | 4/1972 | Heinricy | 156/571 X |
| 3,847,704 | 11/1974 | Stirnemann | 156/572 |
| 3,941,368 | 3/1976 | Munch | 271/94 X |
| 3,944,455 | 3/1976 | French | 156/584 X |
| 4,181,561 | 1/1980 | Seragnoli | 156/571 X |
| 4,210,481 | 7/1980 | Wolff et al. | 156/571 X |
| 4,212,700 | 7/1980 | Buchholy | 156/571 X |
| 4,253,902 | 3/1981 | Yada | 156/584 X |

*Primary Examiner*—Edward Kimlin

*Assistant Examiner*—Merrell C. Cashion

*Attorney, Agent, or Firm*—Charles E. Baxley

[57] ABSTRACT

The labeling machine comprises a stationary label hopper, a rotatable turret provided with suction means located adjacent to the leading edge of the terminal label in the article and constructed to enter into the hopper to lift by vacuum the leading edge of the terminal label out of the hopper and then in coaction with a pressure roll to mechanically withdraw the remainder of the label from the hopper and insert such leading label edge into the entry end of a fixed label guideway. Located intermediate the ends of the guideway and clamping the label in the guideway therebetween are a feed roll and a pressure roll spaced from the turret a distance substantially less than the length of the label so that they clamp the label before it moves past the turret and its associated pressure roll. Positioned adjacent to the discharge end of said guideway is a rotatable glue roll onto which the label is directed as it is discharged from said guideway. The turret and its associated pressure roll, the feed roll and its associated pressure roll, and the glue roll each impart to the label during their mechanical feed thereof, a corresponding given linear velocity. Associated with the glue roll are means for transferring the label from the glue roll to a label applying station without diminishing the given linear velocity of the label. The transfer means may constitute spaced stationary guide plates having guide edges shaped to transfer the label directly to the applying station, or to a label applying drum constructed to carry the label to the applying station and attach it to an article at such station.

5 Claims, 8 Drawing Figures

LABELING MACHINES

CROSS REFERENCE

This is a continuation-in-part application of our copending U.S. application Ser. No. 382,940 filed May 28, 1982 currently pending.

THE INVENTION

This invention relates to labeling machines and, more particularly, to an improved label feed means for delivering cut labels from a stationary label hopper in the labeling machine to a station at which the labels are applied to articles.

The principle object of this invention is to provide a high speed labeling machine, in which the label feed means exercises positive control over the label throughout its entire period of travel from a stationary hopper to the label applying station. This object is attained, in accordance with the invention, by utilizing vacuum to initially lift the leading edge of the terminal label in the label supply stack free of the hopper containing such stack and then to positively transfer such terminal label mechanically in a confined path from the hopper to the label applying station.

Another object of the invention is to provide an improved label feed means capable of feeding at high speed batches of labels composed of a wide variety of different sized labels from one given source to the label applying station without change in the parts of such feed means.

Other objects of the invention, as well as the advantages and novel features thereof, will become apparent from a perusal of the following description when read in connection with the accomying drawings, in which.

Figure 6:
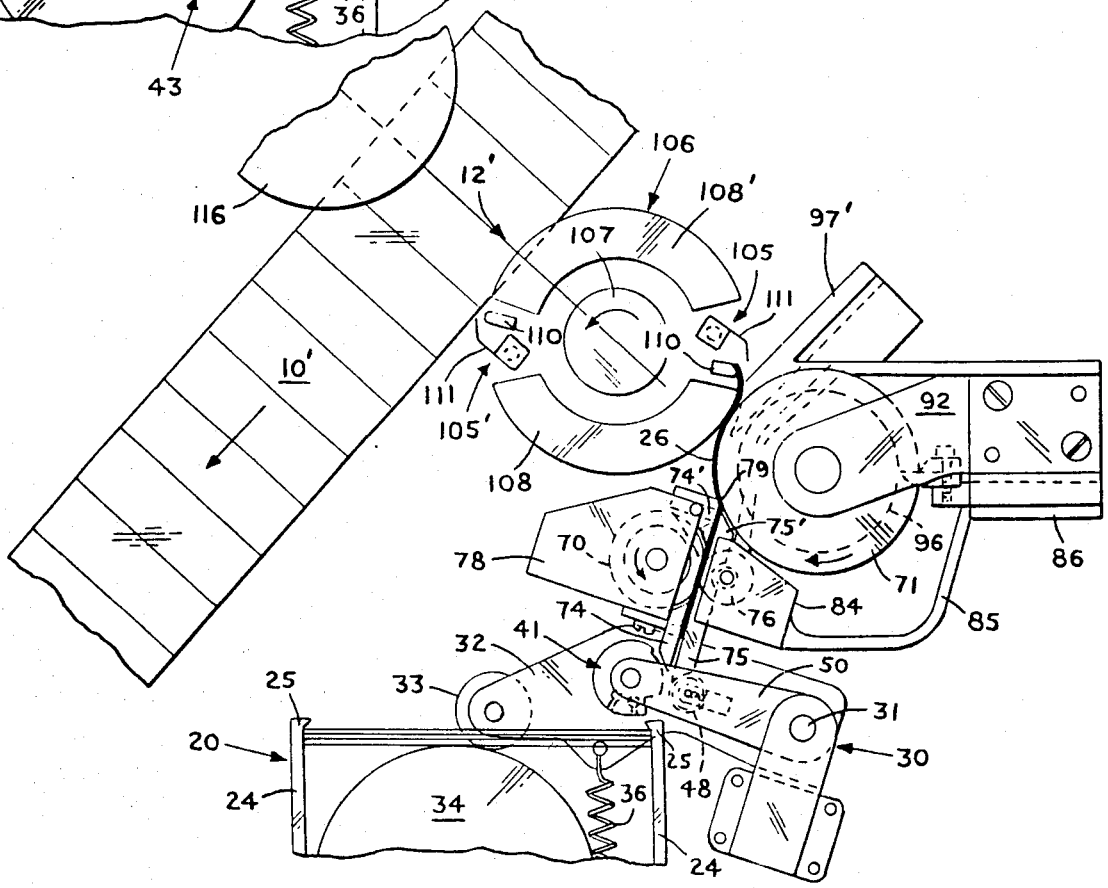
Figure 7:
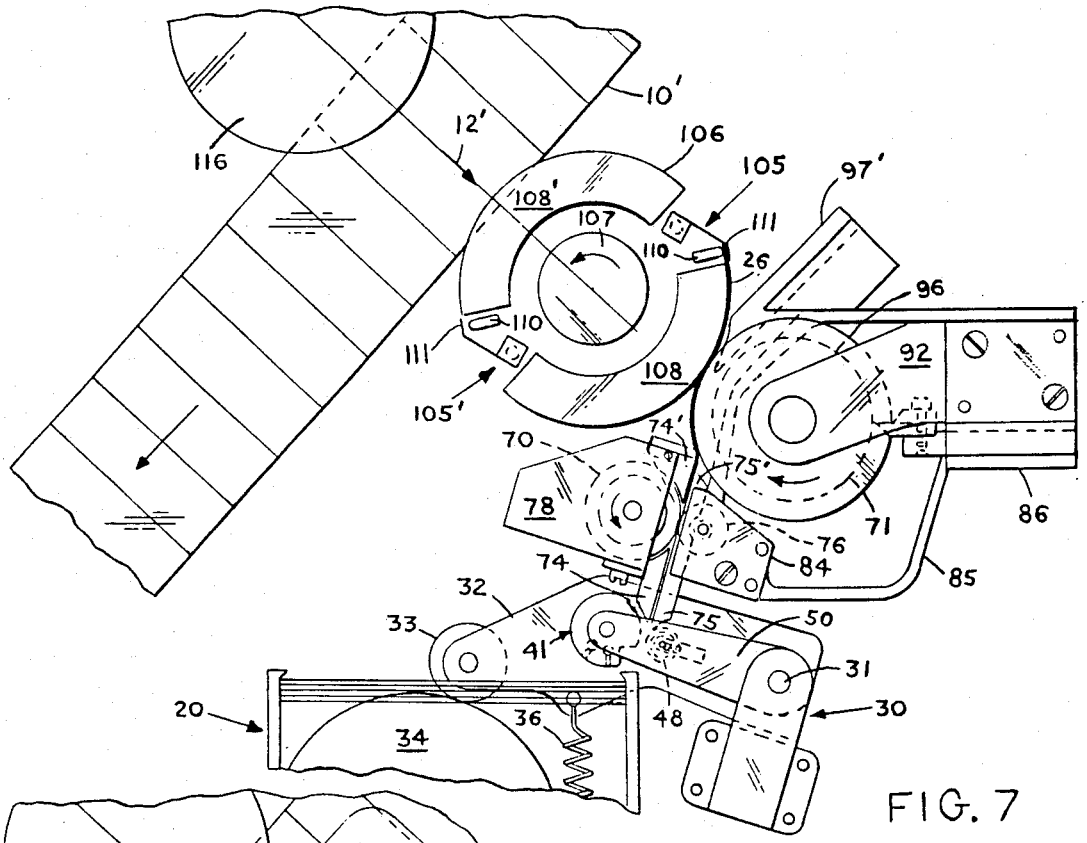
Figure 8:
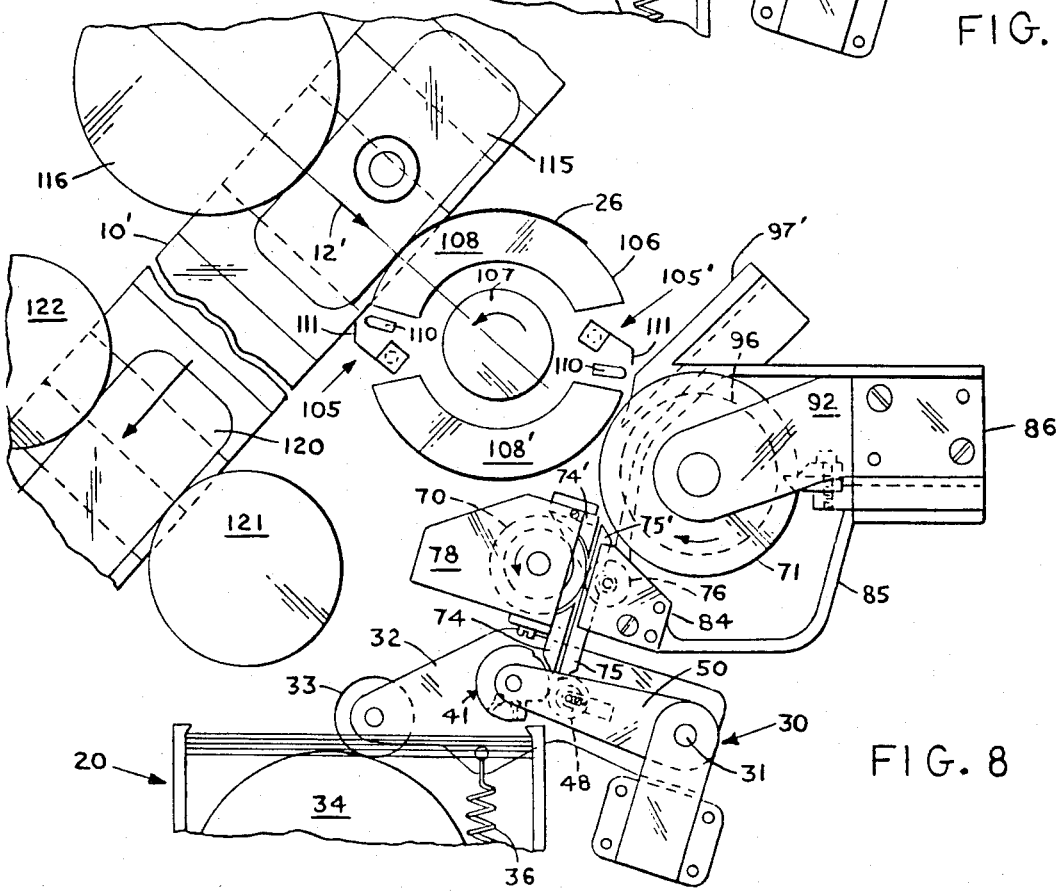

FIG. 6 is an enlarged diagrammatic plan view of the essential parts constituting the label feed means of this invention modified to feed labels from a stationary hopper to a label applying station to which are supplied odd-shaped articles, such as the rectangularly-shaped bottle illustrated in FIG. 8, the view showing a label removed from the hopper and being fed at its advancing end to an article applying drum; and FIGS. 7 and 8 are views similar to FIG. 6 and show the manner in which the article applying drum carries the label to the applying station and applies it to an odd-shaped article.

Figure 1:
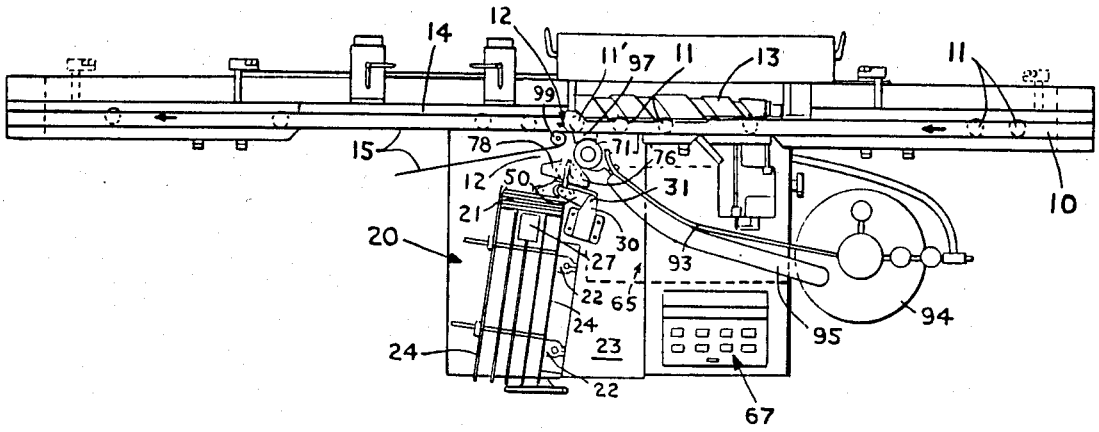
FIG. 1 is a diagrammatic plan view of a labeling machine built in accordance with the invention.
Figure 2:
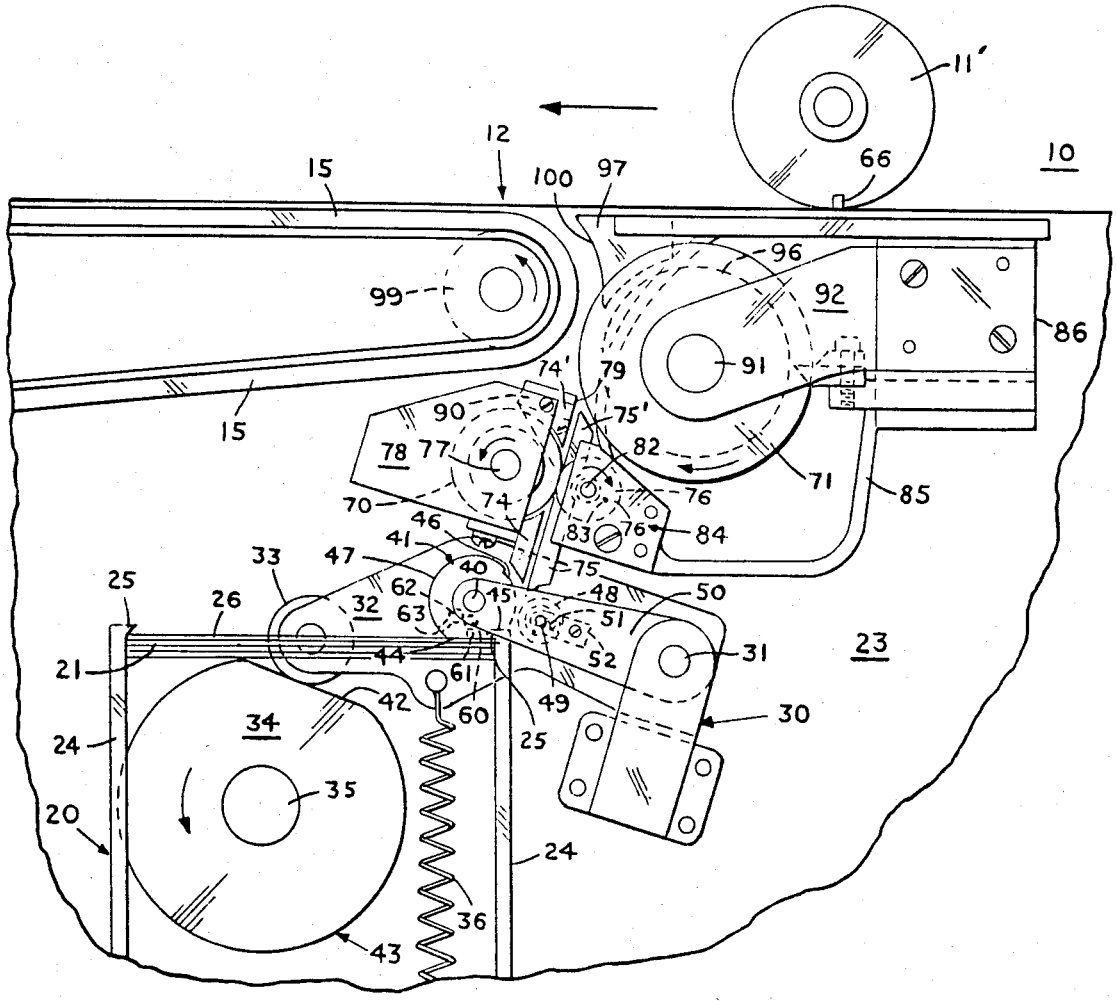
FIG. 2 is a partial diagrammatic plan view of the machine shown in FIG. 1 and showing in enlarged form the essential parts which constitute the label feed means of this invention, the latter being arranged to feed labels to round articles, such as bottles.

Referring now to FIGS. 1 and 2 of the drawings, the reference numeral 10 indicates the conveyor which advances the articles to be labeled, such as the round bottles 11, in a single file to the left, as viewed in such figure, to and past a station 12 at which labels are applied to the bottles. In their travel towards the label applying station 12, the bottles successively engage the entry end of a metering device, such as the feed screw 13 shown mounted for rotatable movement about a horizontal axis and provided with a helically-shaped article engaging channel. The feed screw 13 is located so that its discharge end is adjacent to the label applying station 12. In its operation, the feed screw 13 spaces the bottles 11 apart a predetermined distance determined by the pitch of such feed screw and successively delivers a bottle 11 at the label applying station 12 just ahead of the arrival of the leading edge of the label that is to be applied to that bottle. The timing of the feed of the label is such that the leading edge of a label will arrive at the label applying station 12 at the same time in each cycle of operation of the labeling machine. The metering device or feed screw 13 is adjustable both as to position and pitch to coordinate the arrival of the bottle with that of the label at the applying station. Immediately after the leading edge of a label is brought into engagement with a bottle at the label applying station 12, the bottle with the label so affixed thereto pass through a pressure station constituted of a pressure pad 14 and a pressure belt 15 to press the entire label firmly and in complete securement onto the surface of the bottle. The entry ends of the pressure pad 14 and belt 15 are located at the label applying station and adjacent to the discharge end of the bottle metering device 13 so that a bottle, as it is discharged from the metering device 13 immediately enters the entry end of the pressure station. As has been previously stated, the timing of the feeds of the bottles and labels are such that a bottle which is traveling at a lineal speed equal to that of the conveyor belt 10, arrives at the entry end of the pressure station where it will be gripped between the pressure pad 14 and the pressure belt 15 just ahead of the label front edge at this clamping point. A label arriving at the label station has a lineal velocity equal to that of the pressure belt 15 and substantially twice the lineal speed of the bottle conveying belt 10. When, as stated, a bottle 11 enters the pressure station, it will be caused by the pressure belt 15 to start rotating so that it will roll along the pressure pad 14 without changing the forward velocity imparted to it by the belt 10. Thus, as the bottle 11 with a label attached thereto advances between the pressure pad 14 and the belt 15, the label will be rolled onto the bottle.

The labels are fed to the label applying station 12 from a horizontal hopper 20 in which the labels 21 are stacked vertically. The hopper 20 is located in front of the conveyor 10 and is disposed substantially tranversely thereto in the region of the label applying station 12; the inner or discharge end of the hopper 20 being only slightly spaced forwardly from the entry end of the pressure station. The hopper 20 is a stationary hopper that is mounted on fixed supports 22 rising from the top of a table 23 of the machine. In accordance with known construction, the hopper 20 is adjustable on the supports 22 and the label supporting members thereof are adjustable to receive labels of different sizes. The label guide bars 24 of the hopper are provided at their inner ends with label retaining edges 25 typical with labeling machine hoppers. The successive terminal labels 26 in the stack are maintained in engagement with such retaining edges by a pusher plate 27 in a customary manner.

Mounted on the table 23 to one side of the label hopper 20 is an upright bracket member 30 rotatably supporting a vertically disposed rod 31. The bracket member 30 is so located with relation to the label hopper that the rod 31 is positioned adjacent to the right side of the discharge end of the hopper 20, as viewed in FIG. 1 of the drawings. As is shown more clearly in FIGS. 2–5 of the drawings, there is secured at one end to the rotatable rod 31 and located below the hopper 20, an arm 32 which extends under the discharge end of the hopper to a position approximately midway of the hopper's width. Mounted on the outer end of the arm 32 is a cam roll 33 which engages the periphery of a cam 34 mounted on a vertical shaft 35 which extends below the table 23 and is connected to the main drive of the labeler to rotate the cam 34 in a counterclockwise direction, as indicated by the arrow thereon. The cam roll 33 is maintained in engagement with the peripheral cam surface of the cam 34 by a spring 36 which is attached at one end to an intermediate portion of the arm 32 and is connected at its other end to a fixed portion of the labeler.

Also mounted on the arm 32 is label transfer mechanism comprising a vertical shaft 40 which extends through and is supported by a vertical bearing (not shown) mounted in depending relation on the arm 32. Connected to the lower end of shaft 40 in a manner known to the art is a variable offset drive coupling of the type made by Schmidt Coupling, Inc. of Cincinnati, Ohio, to transmit rotational movement to shaft 40 while it is being shifted horizontally by the pivotal movement of arm 32 under the influence of the cam 34 and cam roll 33. The variable offset drive coupling connects the shaft 40 to the output shaft of an intermittently indexing drive mechanism mounted on the table 23 beneath the arm 32 but not shown. The indexing drive mechanism may be of the type made by the Cyclo-Index Corporation of Cleveland, Ohio, and is suitably connected to the main drive of the machine in a manner known to the art. As will hereinafter become more clear, the indexing drive mechanism is adapted to cause the shaft 40 to make a complete revolution of varying velocity during a given portion of each cycle of the machine and of each revolution of the cam 34.

Secured to the shaft 40 which extends axially therethrough is a substantially cylindrical label gripper vacuum head or label transfer turret 41 of given radius. It will be noted from FIGS. 2–5 of the drawings that the shaft 40 and turret 41 are so located on the arm 32 that they extend upwardly from the arm 32 in front of the terminal label 26 in the stack 21 adjacently to the right hand label retaining edge 25 of the hopper 20 and so that when the cam roll 33 is in engagement with the flattened portion 42 of the cam surface 43 of the cam 34, a longitudinally extending vertical plane surface portion 44 of the turret 41 will be in engagement with that vertical edge portion of the terminal label 26 adjacent to the right hand label retaining hopper edge 25; such label edge portion being hereinafter referred to as the leading edge of the label. It is to be noted that the radial distance of the surface portion 44 is less than the given turret radius. The turret surface portion 44 forms with a longitudinally extending transverse surface portion 45 a longitudinal slot that enables the turret to clear the adjacent hopper edge 25 as it enters the hopper 20 to bring its vertical plane surface portion 44 into engagement with the adjacent vertical side edge or leading edge of the terminal label. Adjacently in advance of the turret surface portion 44 and said slot is one end of a peripheral curved surface portion 46 of the turret with a radius less than that of said given turret radius. Thus, while the turret surface portion 44 is engaging a terminal label 26 in the hopper 20 and until the turret 41 has rotated in a counterclockwise direction approximately 90°, the peripheral surface of the turret will be out of engagement with a cooperative pressure roll 48 extending in vertical parallel relation to the turret 41. The pressure roll 48 is rotatably mounted on a vertical shaft 49 shiftedly supported at its ends by the arm 32 and an upper arm 50 which is secured to the rotatable rod 31 and connected at its outer end to the upper end of the shaft 40. The pressure roll 48 is biased toward the turret 41 by spring 51 engaging the end portions of the shaft 49 and mounted on brackets 52 secured to opposing sides of the arms 32 and 50. The periphery of the spring loaded pressure roll 48 will normally be spaced from the axis of the turret 41 a distance less than said given radius so that the end of said 90° movement of the turret, the pressure roll 48 will engage and yieldingly press against the peripheral surface portion 47 of the turret having said given radius.

Located in the turret 41 in the region of the surface portion 44 is a vertical suction passgeway 60. Branching out from the passageway 60 are a longitudinally extending series of short horizontal passageways 61 forming a vertical line of suction openings in the face of the plane surface portion 44. A second vertical suction passageway 62 in the turret is located adjacent to the passageway 60 in the region of the juncture of the plane surface portion 44 with the peripheral surface portion 47. Also branching out from the passageway 62 are a longitudinally extending series of short horizontal passageways 63 forming a vertical line of suction openings in the peripheral surface portion 47 adjacently to its line of juncture with the plane surface portion 44. The lower ends of the passageways 60 and 62 are in communication with known valving means forming part of known control mechanism contained in a control box 65 located below the table 23 (see FIG. 1) and controlled in a known manner by an index switch operated by a known electrical control device 66 that is located opposite feed screw 13 and is operated by the containers 11. The valving means connects the passageways 60 and 62 to a source of suction in a known manner.

The control device 66 is located adjacent to the conveyor 10 between the ends of the feed screw 13 and positioned at a given distance from the label applying station 12. Thus, when a bottle 11' on the conveyor 10 actuates such control device 66 as the bottle 11' is positively moved toward the label applying station 12 by the feed screw 13, a signal is sent to said electrical control means to actuate a known rotary vacuum valve forming part of said valving means and cause it to connect the series of vacuum holes 61 in the turret 41 to the source of suction. At this time, the turret 41 is stationary and positioned as shown in FIG. 2 of the drawings, with its plane surface portion 44 in engagement with the terminal label 26 in the hopper to pick it from the stacked supply of labels 21. At this time also, the cam roll 33 is in engagement with the cam surface portion 42 of the cam 34. As the cam 34 rotates in a counter-clockwise direction, the cam roll 33 rides up onto the cylindrical cam surface 43 thereby moving the arm 32 rearwardly about the longitudinal axis of the rod 31 against the tension of the spring 36. This rearward pivotal movement of the arm 32 retracts the vacuum turret from the label supply stack 21 causing the right hand or leading edge of the terminal label 26 to be lifted from the stack. As the leading edge of the terminal label moves beyond the label retaining edge 25 of the adjacent hopper guide bar 24 the turret 41 is caused by the aforementioned cyclo-index drive to rotate in a counterclockwise direction. The cyclo-index drive is arranged to accelerate the turret from its stationary position to a constant circumferential velocity equal to the continuous circumferential velocity of a feed roll 70 and an adhesive applying roll 71. The feed roll 70, the adhesive applying roll 71 and the pressure belt 15 are directly connected by suitable gearing so that the circumferential velocity of the feed roll 70 and the adhesive applying roll and the lineal velocity of the pressure belt 15 are substantially the same as the aforesaid constant circumferential velocity of the turret 41. After the terminal label being fed from the stack by the turret 41 has been advanced a given extent, the cyclo-index drive will decelerate the turret to zero velocity before it is returned to the stack to pick up a succeeding terminal label 26' (see FIG. 4) in the next cycle of the machine.

Returning now to the initial rotational movement of the turret 41, during such movement the leading edge of the terminal label adhered by suction from the series or line of vacuum holes 61 to the plane surface portion 44, is fed toward the gap between the turret and its associated spring biased pressure roll 48. When the turret has rotated to the extent that the second line of vacuum holes 63 moves into tangency with the terminal label, the aforesaid valving means also connect the source of vacuum to such line of holes. Thus, the leading edge of the terminal label 26 moves into the gap between the turret 41 and the pressure roll 48 held by suction both to the turret plane surface portion 44 and to the following area of its circular surface portion 47. As the rotational movement of the turret continues, the leading edge of the terminal label will enter the space between the turret 41 and the pressure roll 48, and when the first mentioned line or row of vaccum holes 61 is adjacent and tangential to the pressure roll 48 the vacuum in this row is cut off by the aforesaid valving means. The cessation of this vacuum grip permits the leading edge of the label to move away from the turret surface portion 44 and against the pressure roll 48 in which position it will align with a path defined by a plurality of guide members 74,74' and 75,75' and extending from a point adjacent to the turret to a point adjacent to the outer circumference of the adhesive applying roll 71.

Figure 3:
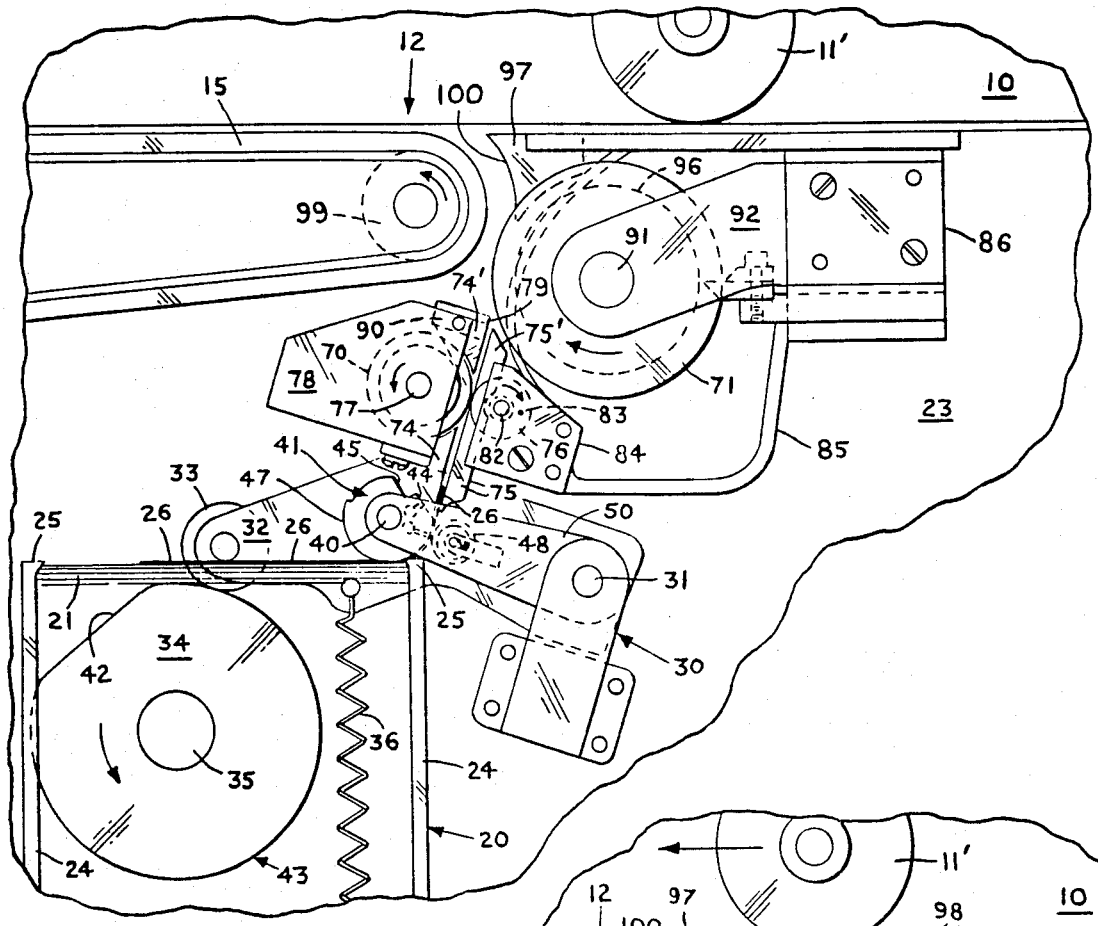
FIGS. 3, 4 and 5 are views similar to FIG. 2 of the essential parts of the label feed means, and show the progressive movements of a terminal label as it is caused to travel by such parts from the stationary hopper to the label applying station.

When the turret 41, in its rotational movement reaches the position shown in FIG. 3 of the drawings with the leading edge of the terminal label inserted into the entry end of the guide members 74,75, the leading edge portion of the terminal label is clamped between the leading end of the turret surface portion 47 and pressure roll 48. At this time, the bottle 11' has moved to the position shown in FIG. 3. At this time also, the vacuum in the second row 63 of vacuum holes is shut off by the aforesaid valving means. Thus, the positively gripped terminal label will now continue on its path between the guide members 74,74', 75 and 75' by the driving friction generated by the clamping pressure between the surface portion 47 of the turret 41 and the spring loaded pressure roll 48, until the feed roll 70 driven at the same circumferential velocity as the turret surface portion 47 and its associated spring loaded pressure roll 76, clamp the front edge of the label between them and take over the forward movement of the terminal label. As is shown in FIG. 2 of the drawings, the feed roll 70 and its associated pressure roll 76 are located between the ends of the passageway formed by the members 74,74', 75, 75' and project into such passageway into the path of travel of the terminal label between such guide members. The feed roll 70 is secured to a counterclockwise driven vertical shaft 77 rotatably supported at its upper end by a bearing plate 78 supported on the upper end of a bracket mounted on the table 23 and provided below the feed roll 70 with a vertical bearing through which the shaft 77 extends to known driving means. The pressure roll 76 is secured to a vertical shaft 82 which is supported for free rotational movement at its upper and lower ends by vertical bearings and which is biased toward the feed roller 70 by suitable springs 83 at such ends. The upper end of the shaft 82 extends through a bearing plate 84 supported by a bracket 85 secured to the adhesive roll mounting 86.

Figure 4:
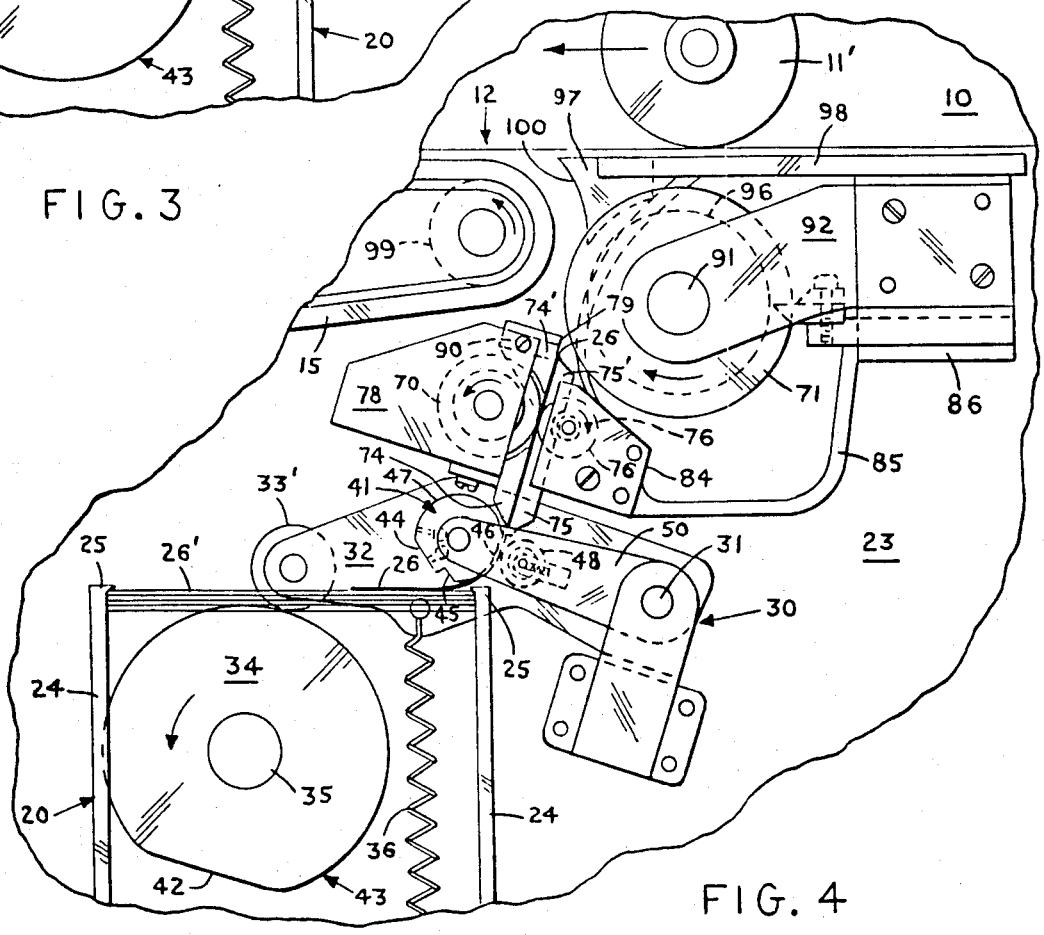

Shortly after the leading end of the terminal label 26 has been clamped by the feed roll 70 and its associated pressure roll 76, the turret 41 has been rotated to the extent that the undercut or relieved surface portion 46 thereof moves into position opposite the pressure roll 48, thereby ceasing the clamping action of the latter on the terminal label and permitting the unclamped trailing portion of the terminal label to pass freely between the turret 41 and the pressure roll 48. As a consequence the terminal label will be fed forwardly toward the adhesive applying roll 71 at the same constant lineal velocity solely by the cooperation between the feed roll 70 and the pressure roll 76. This situation is shown in FIG. 4 of the drawings which also shows the location of the bottle 11' being fed to the label applying station when this unclamping of the trailing portion of the terminal label occurs. As the relieved turret surface portion 46 moves past the pressure roll 48, the previously mentioned cyclo index drive mechanism slows down the rotational movement of the turret 41 and brings it to a stop when the plane turret surface portion 44 comes into opposed relation with the rear surface of the label stack 21 to be ready for its next pick-up stroke into the stationary hopper 20 to bring such turret surface portion 44 into engagement with the succeeding terminal label 26'. It will be understood from the foregoing and from a consideration of FIG. 4 that this completion of the rotation of the turret 41 occurs while the cam roll 33 is still in engagement with the cam surface portion 43 of the cam 34 so that the turret 41 is still held spaced from the label stack 21.

As the terminal label 26 continues its forward movement by the feed roll 70 and the pressure roll 76, the leading edge thereof is engaged by the guiding edge 79 of a tension bar 90 adjustably mounted on the underside of the plate 78. By proper adjustment of the tension bar 90 for the type of paper of which the label 26 is constituted, the guiding edge 79 of such bar will direct such leading label edge as it emerges from the discharge end of the guide members 74',75' towards the outer circumference of the adhesive applying roll 71 so that the label will engage the peripheral surface of the adhesive roll 71 at the correct pressure for proper gluing during the passage thereover. It will be understood that this pressure by the label on the adhesive roll 71 is created as the label bends around the corner 79 of the tension bar 90 and follows the periphery of the adhesive roll 71. The guide members 74' and 75' and the tension bar 90 are so arranged with relation to the adhesive roll 71 that the label is directed substantially tangentially toward the glue roll 71. As previously mentioned, the adhesive roll 71 is rotating with the same circumferential velocity as the feed roll 70 and pressure roll 76, and like the latter two, is mounted on a vertical shaft 91 connected at its lower end by suitable gearing to the main drive of the machine and supported at its upper end by a vertical bearing carried by an arm 92 forming part of the mounting 86. As shown in FIG. 1 of the drawings, adhesive material is supplied by air pressure to the adhesive roll 71 through a conduit 93 from a supply tank 94 and returned to the latter from the periphery of the roll 71 through a conduit 95. The periphery of the adhesive roll 71 is provided with spaced cylindrical grooves 96 into which are recessed stationary label pickoff guides 97 mounted on one end of a plate 98 secured at its other end to the mounting 86.

Figure 5:
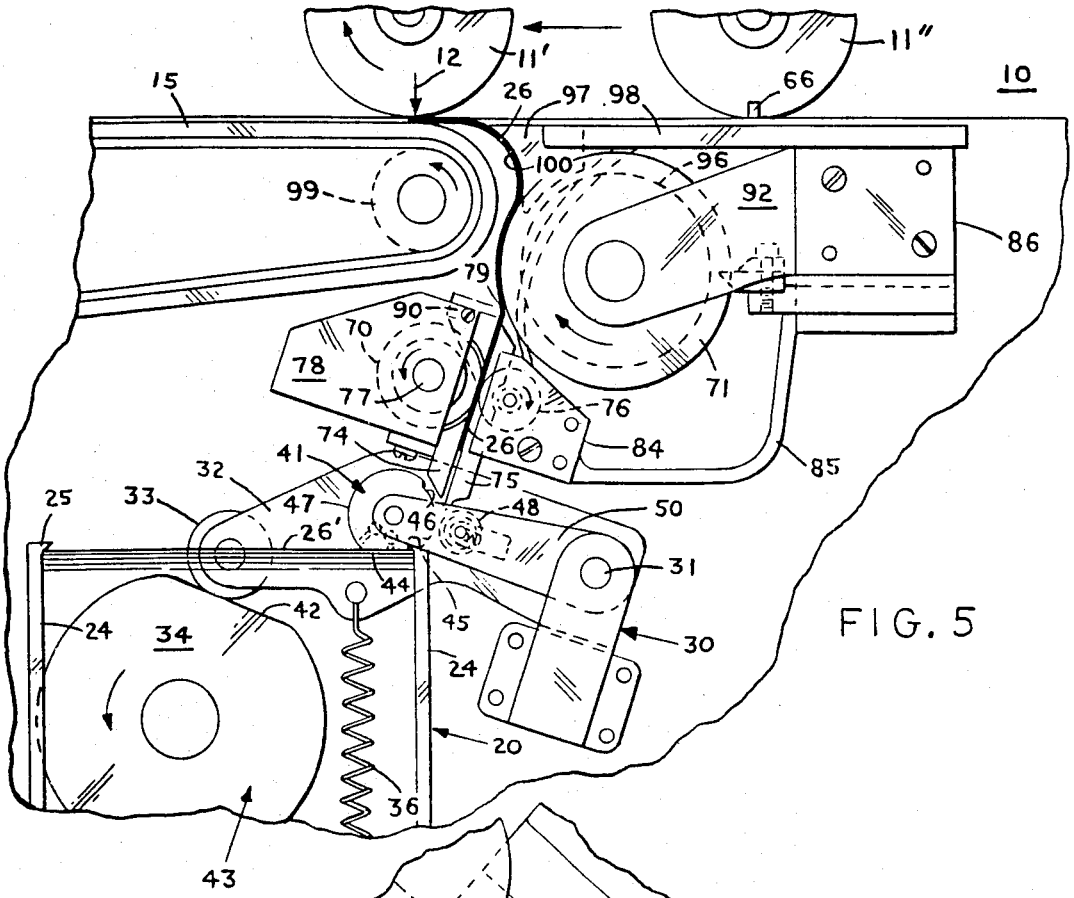

As will be observed from a comparison of FIGS. 4 and 5, as the terminal label 26 being fed by the feed roll 70 and the pressure roll 76 discharges from between the guide members 74',75', it is directed by the guiding edge 79 of the tension bar 90 toward the periphery of the adhesive applying roll 71 which is rotating in a clockwise direction. The label 26 which is advancing at a lineal velocity equal to the circumferential velocity of the adhesive roll 71, is in engagement with the periphery of the adhesive roll 71 for only a short period when it is picked progressively off the periphery of roll 71 by the outer arcuately shaped guiding edges 100 of the guides 97 and directed by the later toward the label applying station 12. As previously indicated, the metering of the label 26 and the bottle 11' is such that the bottle 11' to be labeled arrives at the entrance end of the pressure station where it will be gripped between the pressure pad 14 and pressure belt 15 forming such station just ahead of the leading edge of the label at this clamping point. As has also been previously pointed out, the pressure belt 15 and its guiding pulley 99 are rotating in a clockwise direction at substantially the same lineal velocity as the label 26 which is substantially twice the lineal speed of the conveyor 10. Thus, as the bottle 11' is clamped between the pressure belt 15 and the pressure pad 14 it will be rotated clockwise without change in its forward velocity. Consequently, as the pick-up guides 97 force the advancing label 26 into a curved path around the adjacent end of the pressure belt 15 and toward the labeling station 12, the leading edge of the label will become pinched between the rotating bottle 11' and the moving pressure belt 15 in the region of the latters guiding pulley 99, as shown in FIG. 5. As the article 11' and the label 26 continue their advancing movement, the label will be rolled onto the bottle by the pad 14 and belt 15. As is also shown in FIG. 5, about the time the leading edge of label 26 has been applied to the bottle 11', the trailing end of label 26 has cleared the turret 41 and is located in the path defined by the guide members 74,74', 75,75'; the cam roll 33 has advanced onto the flattened cam surface portion 42 of the cam 34, thereby enabling the spring 36 to advance the arm 32 to bring the plane surface portion 44 of the turret 41 into engagement with the outer surface of the succeeding terminal label 26'; the article metering device 13 has advanced a succeeding bottle 11'' to a position to actuate the control device 66 to connect the line of vacuum holes 61 in the turret to the source of vacuum; and a new cycle of operation of the labeling machine has started.

It will be seen that as a result of the above described construction, vacuum is utilized to lift the leading edge portion of each terminal label out of a stationary label hopper and to accelerate a lengthwise movement of the terminal label out of the label hopper from an at-rest position to a given lineal velocity. Shortly after the leading edge portion of the terminal label has cleared the structure of the label hopper and while the trailing body portion of the label is still in the hopper, the label is mechanically transferred in a confined path from the stationary hopper past a glue roll and onto the article to be labeled. Consequently, there is a positive control of the label all the way from its removal from the hopper to its attachment to the article. The manner in which the mechanism of this application exerts such positive control of the labels enables labels of a wide variety of sizes to be fed to the labeling applying station at high speed without change in the parts of such mechanism. Thus, the disclosed mechanism makes short runs of labels possible, quickly and inexpensively. The set relation of the guiding edge 79 of the adjustable tension bar 90 with respect to the periphery of the glue roll 71 assures that a thin, even coating of adhesive will be applied to each label that is constituted of a given type of paper.

The aforedescribed label feeding and gluing mechanism is readily adaptable to the labeling of odd-shaped articles as well as the substantially round articles shown in FIGS. 1–5. FIGS. 6–8 of the drawings shows a label handling system such as shown in FIGS. 1–5 of the drawings adapted to the labeling of nonround articles, such as the rectangularly-shaped bottle 115 shown in FIG. 8. In FIGS. 6–8 the parts which are substantially similar to the parts shown in FIGS. 2–5 have been designated by the same reference numerals. Thus, the hopper 20, arm 32, cam roll 33, cam 34, turret 41, pressure roll 48, feed roll 70, guide members 74,74', 75 and 75', pressure roll 76 and adhesive roll 71 shown in FIGS. 6–8 are substantially the same as the same numbered parts shown in FIGS. 2–5 and operate in a similar fashion to positively control the feed of a terminal label 26 from the hopper 20 to the adhesive roll 71. In the arrangement shown in FIGS. 6–8, the pick-off guides 97' which are associated with the adhesive roll 71 in the same manner as the previously described pick-off guides 97, are conformed to direct the leading edge of a label advanced by the rolls 70, 76 and 71 toward the label applying station 12', into one of a plurality of label grippers carried by a label applying drum, generally designated 106. In the mechanism shown in FIGS. 6–8, the label applying drum 106, is shown provided by way of example with two mechanical label grippers generally designated 105,105'. It will be understood that instead of the mechanical grippers shown other suitable mechanical or vacuum grippers may be employed. The applying drum 106 is mounted on the upper end of a vertical shaft 107 connected at its lower end to the main drive of the machine so that it is rotated at a peripheral speed matching that of the metering or feed roll 70 and the adhesive applying roll 71. Provided on the upper surface of the drum 106 are shown by way of example two peripherally located, arcuately shaped, resiliently covered label applying segments 108,108', each of an arcuate length approximating 150°. This is a function of the number of stations or segments on the drum 106. Intermediate the opposed spaced ends of the applying segments 108 are the diametrically opposed label grippers 105,105'. Each label gripper 105,105' comprises a fixed gripper pad 110 and a movable gripper finger 111. Known means are provided to close the gripper finger 111 after the leading edge of a label 26 has been directed by the guides 97' into the open label gripper 105 in the manner shown in FIG. 6 of the drawings. The closed label gripper 105 then positively directs the leading edge of the label 26 toward the applying station 12' as the drum 106 continues its rotational movement, as is shown in FIG. 7 of the drawings. In such travel of the label, it is brought into smooth engagement with the peripheral label carrying surface of the following applying segment 105 due to the relative location of the peripheral surfaces of the adhesive drum 71 and the segments 108,108'. As will be observed in FIG. 8 of the drawings, the length of the peripheral surface of each applying segment is greater than the length of the label 26 being applied to the bottle 115 shown in such figure. The metering of the labels from the label hopper 20 to the drum 106 is such that the leading ends of two successive labels are directed into the open ends of the two grippers 105,105' during each revolution of the drum 106.

The bottle 115 is carried to the labeling station 12' by a conveyor 10' which has a lineal speed that matches the peripheral speed of the label applying drum 106. The drum 106 is so located with respect to the conveyor 10', that the peripheral label applying surfaces of the segments 108,108' overlie the adjacent longitudinal edge portion of the conveyor 10'. Positioned directly across the conveyor 10' from the drum 106, is a back-up drum 116 which overlies the other longitudinal edge portion of the conveyor 10' and is spaced from the drum 106 so that the distance between the peripheral surfaces of the latters applying segments 108,108' and the peripheral surface of the drum 116 is slightly less than the width between the bottle surfaces engaged by the drums 106,116. The drum 116 is connected to the main drive of the machine to rotate at a peripheral speed equal to that of the drum 106 and substantially matching that of the label metering roll 70 and the adhesive applying roll 71. The bottle 115 is fed to the labeling station 12' by known metering means (not shown) which times such arrival so as to locate that surface portion of the bottle to which the leading edge of the label is to be applied in correct relationship to such leading edge at the time the latter is moved by the drum 106 to its line of contact with such bottle surface portion. As the bottle 115 passes between the applying segment 108 of drum 106 and the back-up drum 116, they progressively press or squeeze the surface of the bottle to be labeled into the adhesive coating on the label causing the label to adhere progressively to the article. When the bottle 115 has advanced and the drum 106 has rotated to the positions shown in FIG. 8 of the drawings where the label has only been partially applied to the bottle by the label applying segment 108 of drum 106 known means (not shown) come into operation to open the gripper finger 105 and release the leading end of the label. As is shown in FIG. 8, the labeled bottle 115 is carried by the conveyor 10' from the label applying station 12' to a pressure station 120 where the label is completely pressed into contact with the bottle by two rolls 121 and 122 rotating at the same peripheral speed as the backing roll 116.

While we have hereinabove described and shown in the drawings, preferred embodiments of our invention, it will be apparent to those skilled in the art that changes and modifications may be made therein, without departing from the spirit of the invention, or the scope of the appended claims. For example, a machine embodying the novel features depicted in FIGS. 6–8 could be constructed to simultaneously apply front and back labels to a container. In such a construction, the back up drum 116 would be replaced by an applying drum constructed similarly to drum 106. This second applying drum would have associated with it, in the same manner as the applying drum 106, a second set of parts similar to those associated with drum 106 and constituting among other parts a hopper 20, arm 32, cam roll 33, cam 34, turret 41, pressure roll 48, feed roll 70, guide members 74,74', 75 and 75', pressure roll 76 and adhesive roll 71. In such a front and back label applying machine, the front and back sets of parts would preferably be mounted on two carriers adjustably mounted on the table 23 to move the sets transversely of the longitudinal centerline of the conveyor 10' so as to adjust the pressure of application of the two labels as the bottle 115 passes therebetween. Further, in such a construction the operation of the two sets of parts would both be controlled by the bottle detector device 66 in the manner previously explained. The drive for one of the set of parts preferably is taken from the other set of parts so that the leading edges of the labels will remain in proper relation to each other as they pass from the hoppers to the applying station. Also, one of the set of parts may be mounted on a carrier in a manner known to the art that will enable it to be rotatably adjusted with relation to the other set of parts. By such an adjustment one label may be advanced or retarded relative to the other as it is applied to the bottle, as in the case where one of the labels is different in width from the other.

A roll label attachment can be introduced in a manner known to the art permitting the severed labels from the roll to follow the same path through the machine as hoppered cut labels. This label handling system can also dispense glued labels, or labels with an adhesive coating, to containers controlled by a continuous rotating turret which will brush and roll the label firmly in place in a manner known to the art. The adhesive coating, as is well known, would be inert until activated by moisture or heat. In such an arrangement with the use of the adhesive coating, the glue roll would no longer contain glue, but may be fabricated as a well-known adhesive activation roll wherein the activation roll would be heated or wetted as may be required for activating the coating on the label to adhere to a bottle or other container on the conveyor.

We claim:

1. In a labeling machine, a hopper for carrying a stack of labels, a label applying station, and means for successively and positively feeding labels from said hopper to said applying station comprising:

a rotatable turret provided with suction means located adjacent to the leading edge of the terminal label in said hopper and adapted to lift by vacuum such leading label edge out of said hopper and then to mechanically withdraw such label from said hopper;

means for reciprocating said turret in displacement from an opening in said hopper, said reciprocating means including a cam and a cam-follower arm carring said turret, said cam follower arm being operatively driven by said cam during a rotation of said cam, the radius of said cam varying to provide for reciprocating motion of said turret relative to an end portion of said stack of labels, thereby to provide for engagement of said turret periodically with a new label;

a first guide means defining a given path of travel for the label, a first pressure roll cooperating with said turret to mechanically draw such label from the hopper and to advance the leading edge thereof into the entry end of said first guide means, said turret being constructed of varying radius to provide for a periodic variation in pressure provided against said label by said first pressure roll;

a rotatable feed roll and a second pressure roll located to coactively engage the label intermediate the ends of its given path through said first guide means and prior to the release of the label by said turret and said first pressure roll, a rotatable adhesive activation roll located to receive the label on its peripheral surface as the label is discharged from said first guide means, said turret and its coacting first pressure roll, said feed roll and its coacting second pressure roll, and said adhesive activation roll each imparting to the label during their mechanical feed thereof, a corresponding given linear velocity, and means for transferring the label from said glue activation roll to said applying station without substantially diminishing such given linear velocity thereof; and wherein said adhesive activation roll is void of glue, and wherein said labels are coated with an adhesive.

2. In a labeling machine, a dispenser for carrying a supply of labels, a label applying station, and means for successively and positively feeding labels from said dispenser to said applying station comprising:

a rotatable turret provided with suction means located adjacent to the leading edge of the terminal label in said dispenser and adapted to lift by vacuum such leading label edge away from said dispenser and then to mechanically withdraw such label from the dispenser;

means for reciprocating said turret in displacement from an opening in said dispenser, said reciprocating means including a cam and a cam-follower arm carrying said turret, said cam-follower arm being operatively driven by said cam during a rotation of said cam, the radius of said cam varying to provide for reciprocating motion of said turret relative to an end portion of said supply of labels, thereby to provide for engagement of said turret periodically with a new label;

a first guide means defining a given path of travel for the label, a first pressure roll cooperating with said turret to mechanically draw such label from the dispenser and to advance the leading edge thereof into the entry end of said first guide means, said turret being constructed of varying radius to provide for a periodic variation in pressure provided against said label by said first pressure roll;

a rotatable feed roll and a second pressure roll located to coactively engage the label intermediate the ends of its given path through said first guide means and prior to the release of the label by said turret and said first pressure roll, a rotatable glue roll located to receive the label on its peripheral surface as the label is discharged from said first guide means, said turret and its coacting first pressure roll, said feed roll and its coacting second pressure roll, and said glue roll each imparting to the label during their mechanical feed thereof, a corresponding given linear velocity, and means for transferring the label from said glue roll to said applying station without substantially diminishing such given linear velocity thereof.

3. A labeling machine as defined in claim 2 wherein said dispenser is a supply roll holding a set of severed labels.

4. A labeling machine according to claim 2 wherein said glue roll is void of glue and said labels are coated with an adhesive.

5. A labeling machine according to claim 3 wherein said glue roll is void of glue and said labels are coated with an adhesive.

* * * * *